United States Patent [19]

Furrow et al.

[11] Patent Number: 4,566,504

[45] Date of Patent: Jan. 28, 1986

[54] INSERTION TUBE LIQUID EVACUATOR SYSTEM FOR VAPOR RECOVERY HOSE

[75] Inventors: Roger W. Furrow, High Point; Hal C. Hartsell, Kernersville, both of N.C.

[73] Assignee: Gilbarco Inc., Greensboro, N.C.

[21] Appl. No.: 532,290

[22] Filed: Sep. 15, 1983

[51] Int. Cl.[4] ..... B65B 3/18

[52] U.S. Cl. ..... 141/59; 141/45

[58] Field of Search ..... 141/59-60, 141/54-58, 37, 44, 45, 392, 99, 6, 7, 126-127; 220/85 VR, 85 VS; 62/54

[56] References Cited

U.S. PATENT DOCUMENTS

| | | | |
|---|---|---|---|
| 3,869,264 | 3/1975 | Richards | 62/54 X |
| 3,897,193 | 7/1975 | Kattan et al. | 220/85 VR X |
| 3,913,633 | 10/1975 | Hiller | 141/45 |
| 3,926,230 | 12/1975 | Stary et al. | 141/45 |
| 4,197,883 | 4/1980 | Mayer | 141/59 |
| 4,256,151 | 3/1981 | Gunn | 141/59 |
| 4,260,000 | 4/1981 | McGahey et al. | 141/59 |
| 4,273,164 | 6/1981 | Gunn | 141/7 |
| 4,306,594 | 12/1981 | Planck | 141/59 |

*Primary Examiner*—Stephen Marcus
*Assistant Examiner*—Ernest G. Cusick
*Attorney, Agent, or Firm*—Kenneth Watov

[57] ABSTRACT

One end of a flexible hose is inserted into a vapor recovery hose in an area where liquid fuel may accumulate, and the other end of the hose is connected to a pump, for pumping the fuel out of the vapor recovery hose to maintain a clear vapor path.

7 Claims, 2 Drawing Figures

INSERTION TUBE LIQUID EVACUATOR SYSTEM FOR VAPOR RECOVERY HOSE

The field of the present invention relates generally to vapor recovery hoses, and more specifically to such hoses including liquid removal apparatus for maintaining an unblocked vapor recovery path.

In fluid distribution systems, such as gasoline pumping systems for delivering gasoline to the fuel tank of a vehicle, environmental protection laws require that vapors emitted by the fluid being distributed be recovered. One such vapor recovery system includes a vapor recovery hose surrounding a product hose for delivering fuel to a nozzle, typically the nozzle of a gasoline pump. Vapors collected from the vehicle tank at the nozzle end are pushed by positive pressure which develops within the vehicle tank, or sucked by a vacuum, from the nozzle back into the gasoline storage tank of the product distribution system via the vapor return path provided by the space between the product an vapor recovery hoses. At times liquid fuel may overflow from the nozzle into the vapor recovery path of the vapor recovery hose and collect at a low point in the vapor recovery hose causing partial or total blockage of the return path for the vapors. Even partial blockage of the vapor recovery path of the hose must be avoided in order to insure that the product distribution system meets the environmental protection codes imposed by local, state and federal governments.

Various embodiments of the present invention substantially prevent blockage of the vapor path of a vapor recovery hose by including tubing means inserted into an area of the vapor recovery hose where entrapped fluid is expected to accumulate, and connecting pumping means to the tubing means for pumping the fluid out of the vapor recovery hose.

Figure 1:
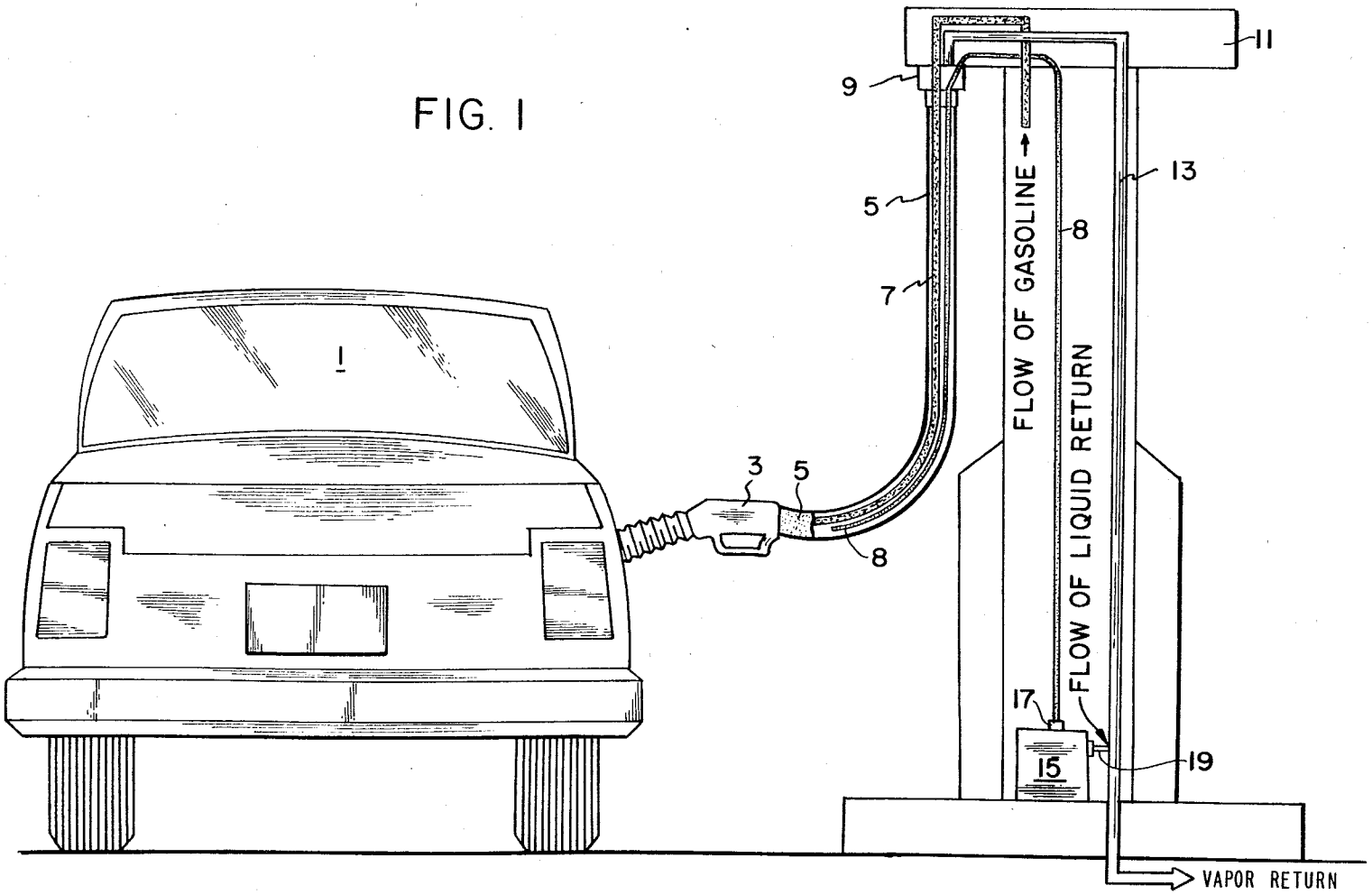
FIG. 1 is a pictorial and partial sectional view of a typical gasoline distribution pump including a first embodiment of the invention.

With reference to FIG. 1, in a typical service station application of the present invention, an automobile 1 is shown being fueled from a gasoline pump 11. A nozzle 3 is shown inserted into the fuel tank in the refueling of the automobile 1. A vapor recovery hose 5 is connected at one end to the nozzle 3, and at its other end to a coupler 9 connected to the gasoline pump housing 11. As shown by the cutaway view of the interior of the vapor recovery hose 5, a product delivery hose 7 is included within the vapor recovery hose 5 for distributing gasoline pumped from a storage tank (not shown) to the nozzle 3. Also carried within the vapor recovery hose 5 is a flexible tubing 8 having an open end located in the area of the vapor hose 5 where liquid fuel is expected to accumulate (due to overflow from the nozzle 3 into the vapor recovery hose 5, during refueling of the automobile 1), in this example. The tubing 8 is fabricated from a suitable material, such as butyl rubber, which is relatively impervious to detremental effects from exposure to gasoline. The other end of the tubing 8 is passed through the coupler 9 and connected to an inlet port 17 of an evacuator pump 15. An outlet 19 of the pump 15 is connected directly to the vapor return line 13, in this example. The vapor return line 13 is connected between the coupler 9 and the gasoline storage tank (not shown), in this example, for returning gasoline vapors collected from the vehicle tank during the fueling process to the storage tank. A suction pump (not shown) may be utilized in returning the vapor to the tank in typical installations.

With further reference to FIG. 1, operation of the invention will now be described. During refueling of the automobile 1, the liquid suction pump 15 is energized to suck away any liquid fuel entrapped in the vapor recovery line 5, and discharge the unwanted fuel via outlet port 19 into the lower portion of the vapor return line 13. The fuel is returned via the vapor recovery line 13 to the storage tank, in this example.

Figure 2:
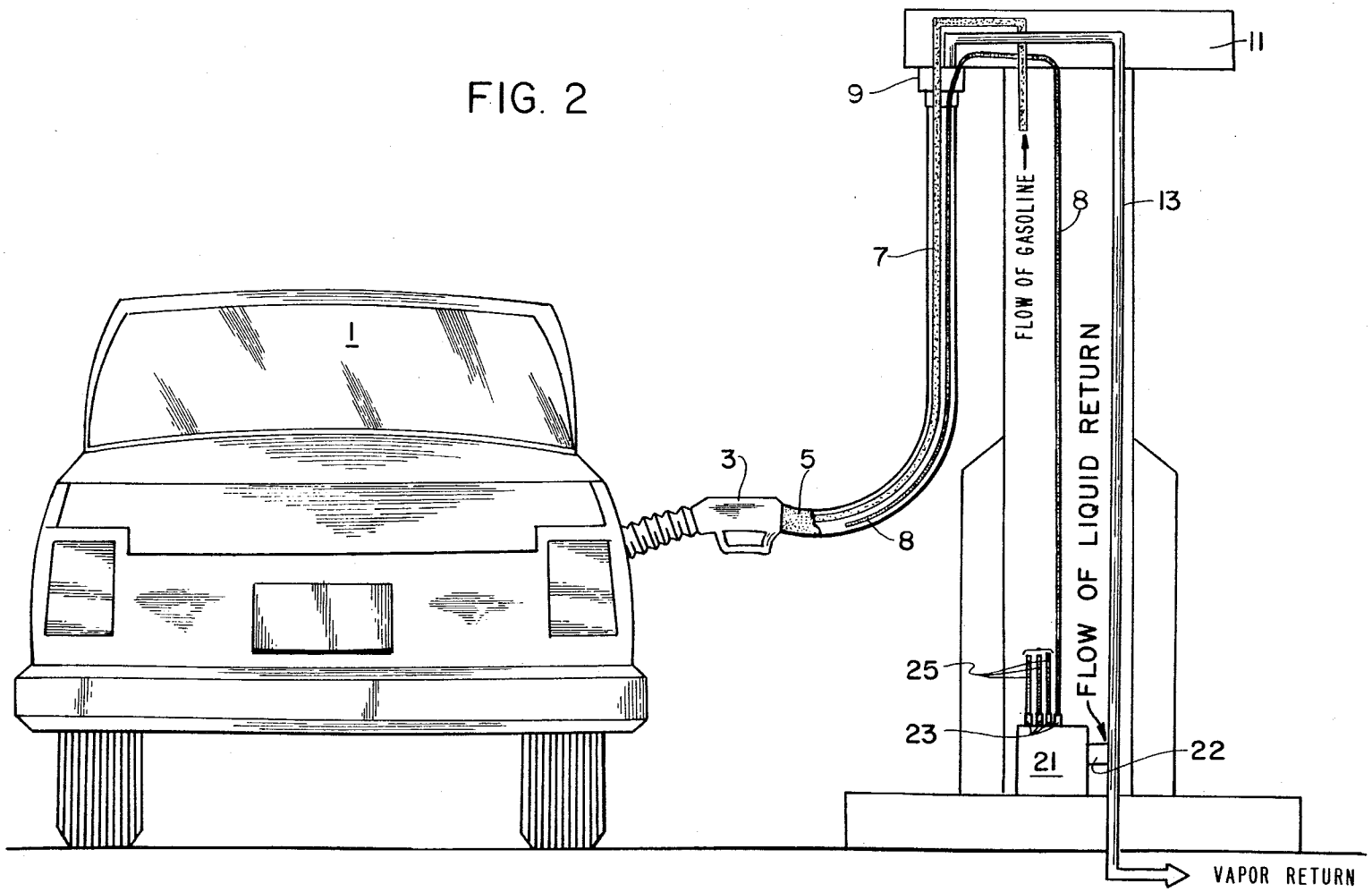
FIG. 2 is a pictorial and partial sectional view of a second embodiment of the invention.

Another embodiment of the invention is shown in FIG. 2. In this embodiment, an evacuator pump 21 includes a plurality of inlet ports 23 for connection to the ends of the evacuator tubing 8, and similar evacuator tubes 25, respectively, for removing liquid fuel entrapped in the vapor recovery lines of a number of gasoline distribution hoses of the service station, thereby reducing the number of evacuator pumps required for maintaining the vapor recovery lines clear of liquid fuel. As previously mentioned, such entrapped liquid fuel would reduce the effectiveness of the vapor recovery system, if permitted to accumulate in the vapor recovery lines.

The evacuator pumps 15 and 21 can be provided by number of known pumps for providing the required function. For example, known electric motorized pumps may be used to provide the function required for pumping the accumulated liquid from the vapor recovery line 5, as previously described. Other than a motor-operated pump, solenoid pumps and product pressure operated pumps may also be applicable for use in the present inventive evacuator system.

Although particular embodiments of the present invention have been shown and illustrated, other embodiments, which fall within the true spirit and scope of the appended claims may occur to those of ordinary skill in the art.

What is claimed is:

1. In a vapor recovery system for a liquid fuel distribution system, apparatus for evacuating liquid fuel from the vapor path of at least one vapor recovery hose coaxial about a fuel product hose, said vapor path being the space between the product and vapor recovery hoses, comprising:

tubing means for providing a pathway for evacuating fuel from said vapor recovery hose, said tubing means being partially inserted within the vapor path between said vapor recovery hose and fuel product hose, one open end of said tubing means being positioned in an area of said vapor path which tends to be a low point where liquid fuel may accumulate during a refueling operation; and pumping means having at least one inlet port connected to the other end of said tubing means, and an outlet port connected to a fuel storage tank of said fuel distribution system, for sucking liquid fuel from said vapor recovery hose via said tubing means, and delivering this liquid from said outlet port back into said fuel storage tank, thereby keeping said vapor path of said vapor recovery hose substantially free of liquid fuel accumulations tending to block said vapor path.

2. The apparatus of claim 1, wherein said liquid fuel distribution system further includes a plurality of individual coaxial hoses each including a vapor recovery hose coaxial about a fuel product hose with a vapor recovery path being formed there between, and wherein said apparatus further includes:

a plurality of tubing means each having one open end located in areas of individual ones of said vapor recovery hoses which tend to be a low point where fuel may accumulate during a refueling operation, respectively, each one of said tubing means providing a pathway for evacuating liquid fuel from the vapor recovery path of its respective one of said plurality of vapor recovery hoses; and said pumping means further includes a plurality of inlet ports connected to the other ends of said plurality of said tubing means, respectively, for sucking liquid fuel from said plurality of vapor recovery hoses to said pumping means via said plurality of tubing means.

3. The apparatus of claim 2, wherein said plurality of tubing means each consist of flexible tubing having smaller outside diameters than said vapor recovery hoses, respectively.

4. The apparatus of claim 1, wherein said tubing means consists of flexible tubing having a small outside diameters relative to said vapor recovery hose.

5. In a liquid distribution system including a product hose for pumping liquid from a storage tank to a nozzle for transfer to another tank, a vapor recovery hose coaxial with and enclosing said product hose, said vapor recovery hose being connected to the nozzle at one end and a vapor return connection at its other end for returning vapors developed about said nozzle (via a vapor recovery path between said vapor recovery and product hoses) to said storage tank, wherein liquid may back up from said nozzle into said vapor recovery path of said vapor recovery hose and tend to accumulate at a low point thereof, causing blockage of the vapor recovery path of said vapor recovery hose, the improvement comprising:

tubing means for providing a pathway for evacuating liquid from said vapor recovery hose, said tubing means having one open end located in said vapor recovery path substantially at the liquid accumulation area of said vapor recovery hose; and pumping means connected to another end of said tubing means for sucking liquid from said vapor recovery hose, and further including means for returning the recovered liquid to said storage tank.

6. In a liquid distribution system including a plurality of product hoses for pumping liquid from a storage tank to a plurality of nozzles, respectively, for transfer to other individual tanks, respectively, a plurality of vapor recovery hoses coaxial with and enclosing said product hoses, respectively, being connected at one end thereof to individual ones of said nozzles, respectively, said vapor recovery hoses being connected at their other ends to vapor return means for returning vapors developed about said nozzles, respectively, from said nozzles via vapor return paths between said vapor recovery hoses and product hoses, back to said storage tank, wherein liquid overflow from said nozzles into said vapor recovery hoses accumulates at low points thereof, respectively, causing blockage of affected ones of the vapor return paths of said vapor recovery hoses, the improvement comprising:

a plurality of tubing means each for providing a pathway for liquid, each having an open end located within the vapor return path in the liquid accumulation areas of said vapor recovery hoses, respectively; and pumping means connected to the other ends of said plurality of tubing means, respectively, for sucking liquid from said vapor recovery hoses via respective ones of said plurality of tubing means.

7. The liquid distribution system of claim 6, further including means for returning the recovered liquid to said storage tank.

* * * * *